US005142739A

United States Patent [19]

Lin

[11] Patent Number: 5,142,739

[45] Date of Patent: Sep. 1, 1992

[54] LOCKABLE HINGE JOINT FOR FOLDING LADDERS

[75] Inventor: Sung C. Lin, Taipei, Taiwan

[73] Assignee: Palhood Industries Corporation, Taipei, Taiwan

[21] Appl. No.: 724,883

[22] Filed: Jul. 2, 1991

[51] Int. Cl.[5] ..... E05D 11/10

[52] U.S. Cl. ..... 16/326; 16/324

[58] Field of Search ..... 16/326, 324

[56] References Cited

FOREIGN PATENT DOCUMENTS 967126 5/1975 Canada ..... 16/326

*Primary Examiner*—Robert L. Spruill
*Assistant Examiner*—Carmine Cuda
*Attorney, Agent, or Firm*—Wenderoth, Lind & Ponack

[57] ABSTRACT

A joint has two inner and two outer shell halves which are mutually rotatably connected together by a central pivot bolt. A ring plate is coaxially rotatably inserted in a space formed between the inner shell half and the outer shell half of one side of the joint. The ring plate has an extended end on one side thereof with a stop, and is provided with a tensioning spring. Between the two outer shell halves in two rectangular slots is accommodated a locking pawl capable of radially moving into and out of the position notches defined on the curved peripheral edge of a disk portion formed by the two inner halves. The locking pawl can be pushed out of the position notch by a pull handle pivotally connected between the two shell halves, and the stop of the ring plate is able to be moved into the gap between the locking pawl and the notch by return tensioning spring force to prevent the locking pawl from entering into the position notch.

8 Claims, 5 Drawing Sheets

LOCKABLE HINGE JOINT FOR FOLDING LADDERS

FIELD AND BACKGROUND OF THE INVENTION

The present invention relates to a lockable hinge joint having two joint members rotatable about a common axis and, more particularly, to a lockable hinge joint comprising a pair of inner shell halves and a pair of outer shell halves riveted together concentrically by a central hinge bolt. The inner shell and the outer shell are capable of mutually turning around at angles from 0° to 180° and capable of being locked at fixed angles by the engagement of a locking pawl provided on the outer shell body in locking slots located on the peripheral edge of a disc portion of the inner shell body.

Conventionally, some positioning lock joints used for folding ladders employ an inner shell member and an outer shell member which are formed separately as integral bodies. In such types of lock joints, fitting and assembly of the internal positioning components present great inconvenience. Not only is the fitting difficult, but also the mounting of the internal locking mechanism results in a reduction of strength, and it may be necessary to provide reinforcement. This reinforcement also brings about an increase in the cost of production. There are other lock joints of multiple-plate combinations, in which the spaces in the interior of the joint are not sufficient for mounting therein the locking mechanism, and as such, the locking mechanism must necessarily be mounted on the outside of the joint. But when the locking mechanism is located on the outside of the joint, there would certainly be damage because of accidental impacts, and also an unharmonious impression of the outer appearance.

In view of the many drawbacks in the conventional positioning joints for folding ladders, the applicant, based on experience in the manufacture of folding ladders and the manufacture of lock joints for many years, has devised and completed a new and improved positioning joint particularly for folding ladders, and, accordingly, it is the main purpose of the present invention to provide a lockable hinge joint for folding aluminum ladders which can be composed and assembled in a most convenient and fast way.

A further object of the present invention is to provide a structure of a lockable hinge joint for folding aluminum ladders which not only can be manufactured with more ease but is also able to cut production costs.

BRIEF DESCRIPTION OF THE DRAWINGS

Other objects and advantages of the present invention will become apparent from the following detailed description of the preferred embodiment, taken in conjunction with the accompanying drawings, wherein.

DETAILED DESCRIPTION OF THE INVENTION

Figure 1:
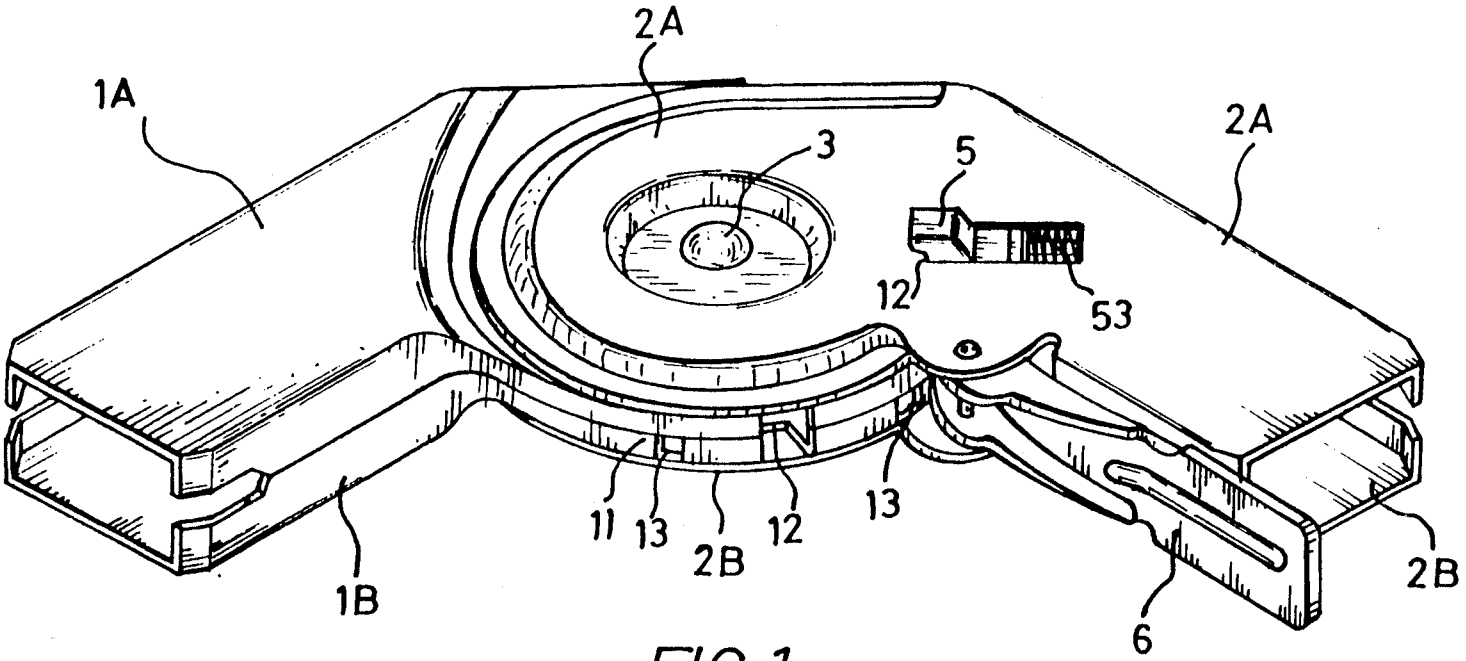
FIG. 1 is an outer perspective view of a lockable hinge joint according to the present invention.
Figure 2:
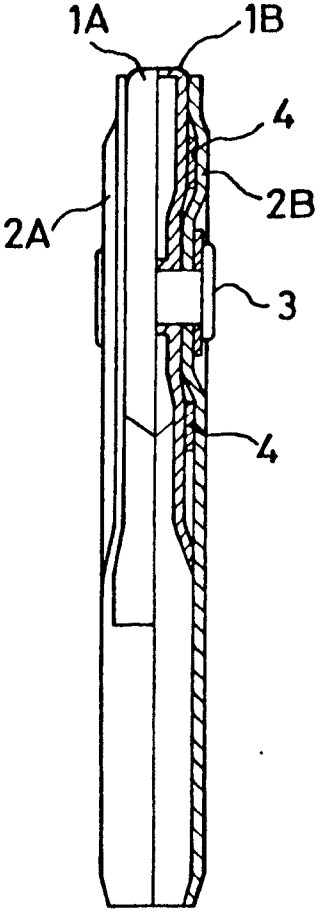
FIG. 2 is a partial sectional side view of the lockable hinge joint.

Referring to FIGS. 1 and 2, there is shown a lockable hinge joint of the present invention which comprises two inner shell halves 1A and 1B mutually rotatable with two outer shell halves 2A, 2B and connected together by an axial bolt or pin 3. On one side of the joint is formed, between the inner shell half 1B and the outer shell half 2B, a space having an unlocking ring plate 4 rotatable and movably located therein (see FIG. 2).

Figure 3:
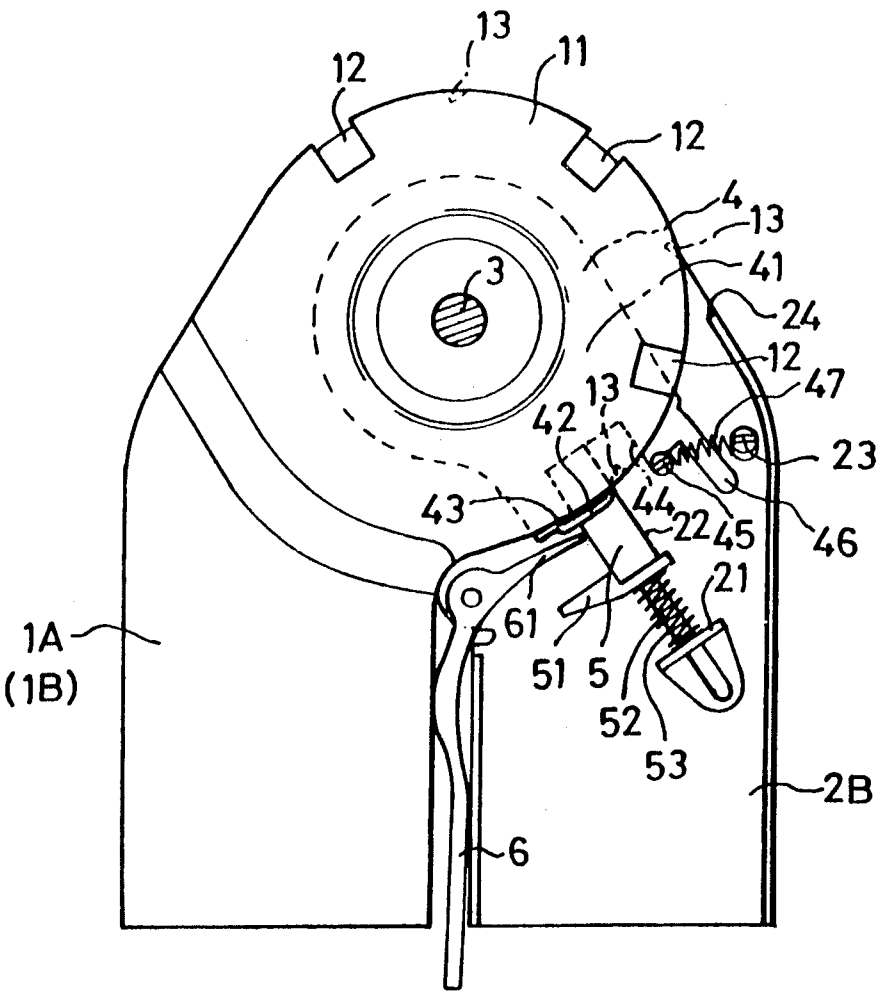
FIG. 3 is a front view of the lockable hinge joint in a folded position where one of the outer shell halves has been removed.

As shown in FIG. 3, when one outer shell half 2A is removed, there may be seen on the other outer shell half 2B a support abutment 21 integrally formed by stamping and bending, a rectangular slot 22 and mounted therebetween a locking pawl 5 capable of moving inside the slot 22. This locking pawl 5 extends out on one side into a projection 51 and at its lower end extends out to form a guide post 52. On the guide post 52 is loaded a compression spring 53 abutting against one side of support 21. To the outer shell member 2, at a place corresponding in position to the locking pawl 5, is pivotally connected a pull handle 6 with one inner end extending out into a claw bar 61 capable of reaching into the moving range of the projection 51.

Figure 8:
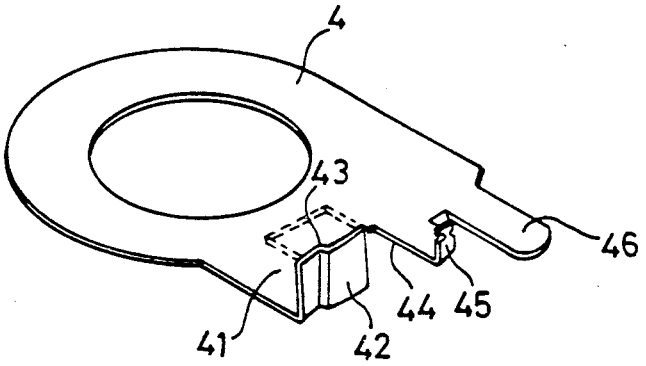
FIG. 8 is a perspective view of an unlocking ring plate of the hinge joint.

The unlocking ring plate 4, as shown in FIGS. 3 and 8, has formed on one side there an of extension 41, which has a vertically bent stop 42. There is formed on the stop 42 a sawtooth raised portion 43 and the terminal part of the stop 42 may be further bent in the opposite direction. On one side of the stop 42 the extension 41 has a notch 44. The notch 44 is vertically bent to form a fixed spring stop 45. From the outer side of the spring stop 45 extends a stop 46, and correspondingly, at an appropriate place on the outer shell half 2B, is formed another fixed spring stop 23. Mounted between the two fixed stop 45 and 23 is a tensioning spring 47.

Referring again to FIG. 3, the disk portion 11 of the inner shell member 1 has in its peripheral edge a plurality of position notches 12. When the inner shell member 1 and the outer shell member 2 are in the parallel condition at their bases, that is, at an included angle of 0°, the locking pawl 5 abuts against the stop 42 against the force of spring 53. The disk portion 11 of the inner shell member 1 has, on the side of the peripheral edge thereof, and spaced in the clockwise direction from the position notch 12 at an appropriate distance, a recess 13.

Figure 4:
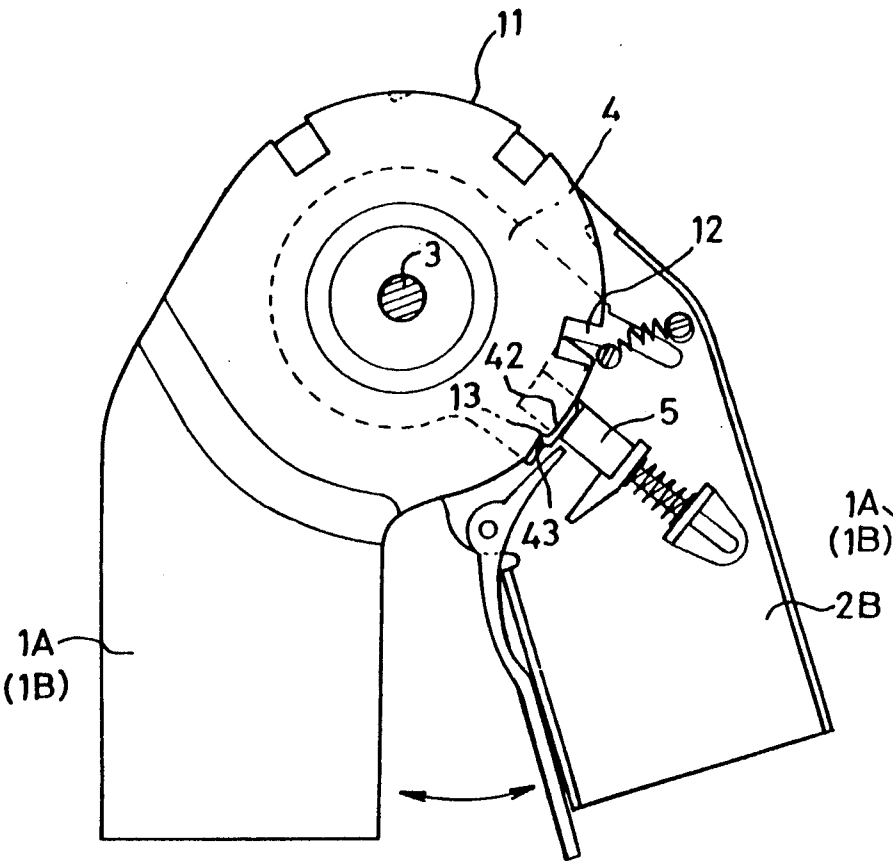

When the inner shell member 1 and the outer shell member 2 are pulled away from each other at their bases, as shown in FIG. 4, the ring plate 4 rotates as a single body along with the outer shell half 2B. When the raised portion 43 of the stop 42 passes over the recess 13, the stop 42 under, the pressure of locking pawl 5, moves the raised portion 43 into engagement with the recess 13.

Figure 5:
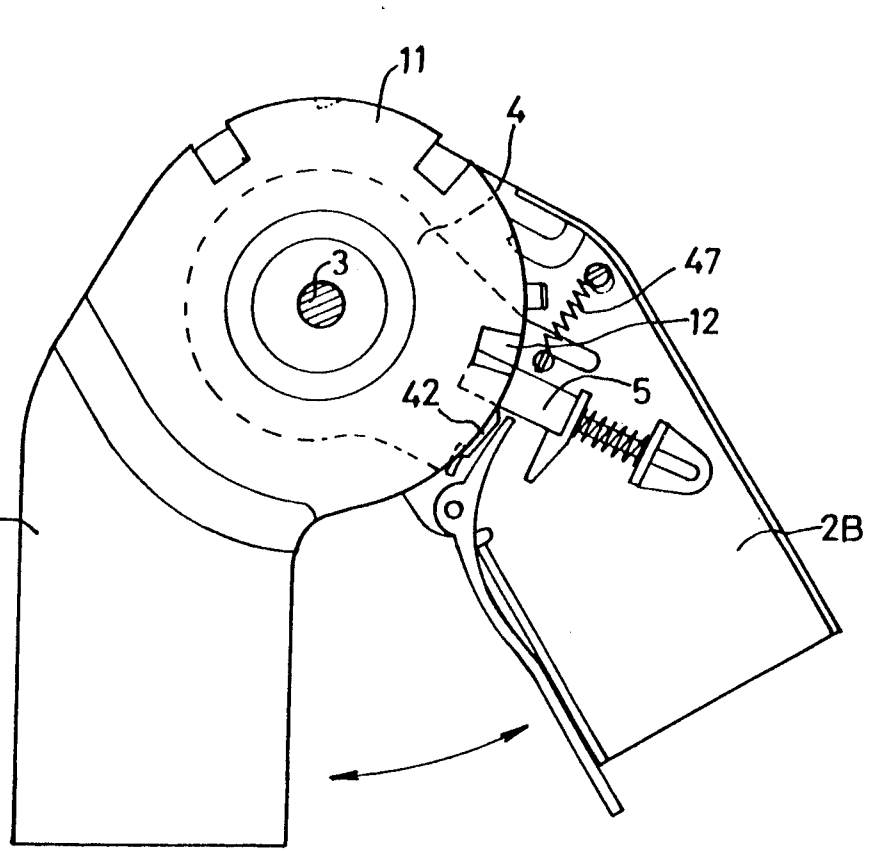
FIGS. 4 to 7 are schematic views showing the operation of the lockable hinge joint.

When the included angle between the two bases of the inner shell member 1 and the outer shell member 2 is continuously enlarged, as shown in FIG. 5, because of the stop 42, which is under the pressure of locking pawl 5 and hindrance from recess 13, the locking pawl 5 slides off of the surface of the stop 42 to abut against the peripheral edge of the disk portion 11 of the inner shell member 1. Because the locking pawl 5 rotates as a single body with outer shell member 2 and the ring plate 4 remains stationary, the spring 47 is thus pulled and stretched.

Figure 6:
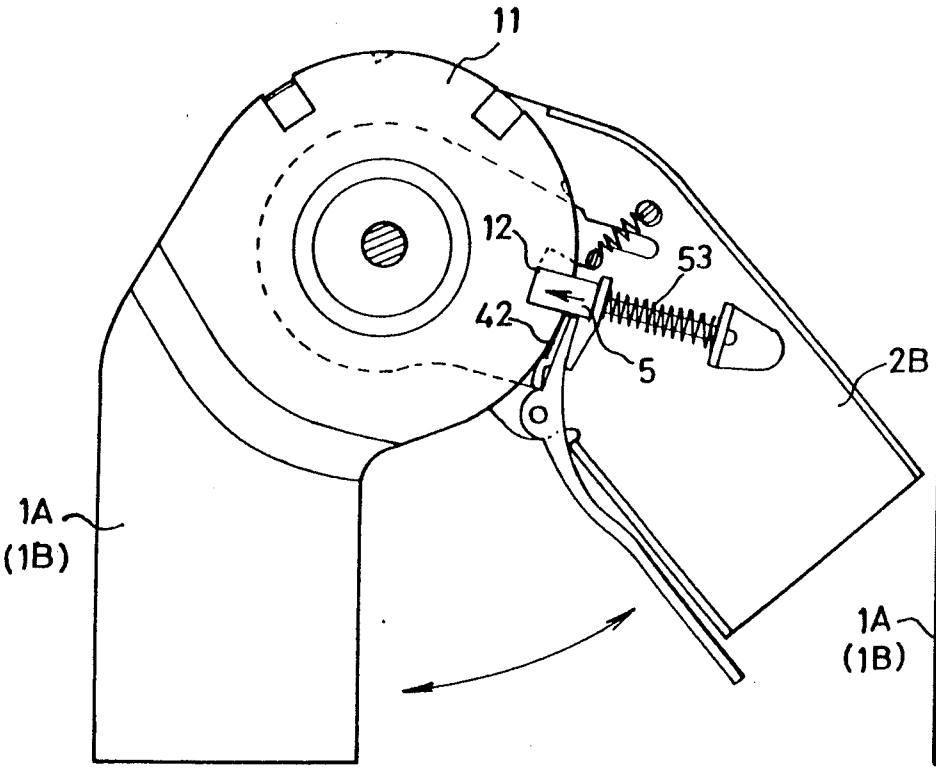

Upon continuing the enlargement of the included angle between the two bases of the inner shell member 1 and the outer shell member 2, as shown in FIG. 6, during the moment when locking pawl 5 passes over the position notch 12, the locking pawl 5, under the pressure of the spring 53, is forced to be engaged in the position notch 12. The inner shell member 1 and the outer shell member 2 are thus locked in engagement with each other at a fixed angle.

Figure 7:
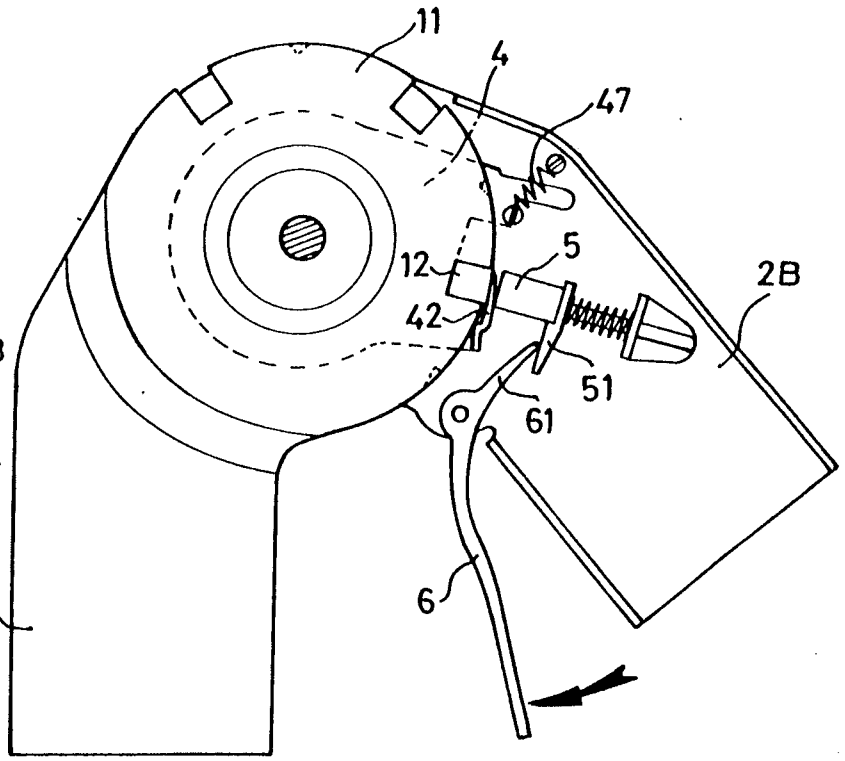

When it is desired to change to another angle, as shown in FIG. 7, all that is required to do is to pull the handle 6 over and permit the claw bar 61 to press against the projection 51 of the locking pawl 5 to push out the locking pawl 5. As soon as locking pawl 5 has been pushed out completely and separated from the position notch 12, and is spaced by a gap from the peripheral edge of the disk portion 11, the stop 42, under the tensioning force of the spring 47, is guided into insertion into the gap and blocks off the position notch 12 so that the locking pawl 5 will not enter the notch again. At this time, the inner and outer shell members are released from engagement with each other and can be stretched out or refolded.

In the operation of the hinge joint of the present invention, as stated in the above, the locking pawl 5, in entering into any of the position notches 12, follows the steps as shown in FIGS. 3 through 7, and hence a separate account will not be given here.

Figure 9:
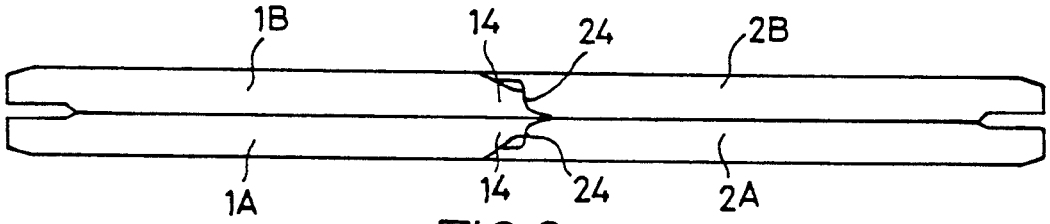
FIG. 9 is a top view of the hinge joint in its extended position (at 180°)
Figure 10:
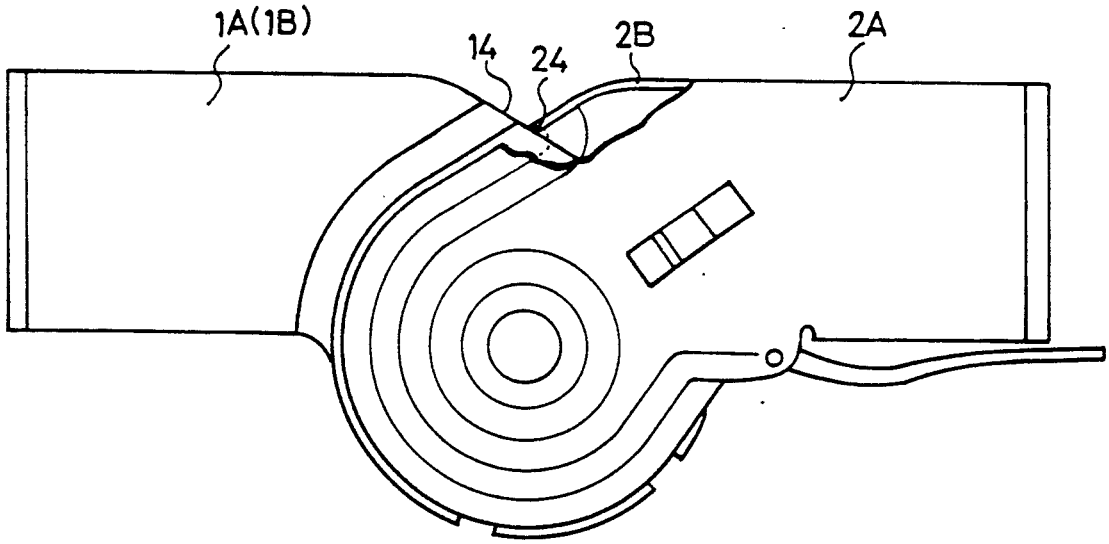
FIG. 10 is a front view of the hinge joint in FIG. 9.

When the bases of the inner and outer shell members of the invention are in the 180° extended position and are locked in engagement with each other as shown in FIGS. 9 and 10, the edges of the back walls 24 of the outer shell halves 1A and 1B lie exactly against the back walls 14 of inner shell halves 2A, 2B, and this greatly enhances the strength of the hinge joint in this position.

From the foregoing, it can be recognized that the joint structure according to the invention is simple, and during setting-up and assembly, the components can be mounted one over the other in sequence until they are in position, thereby simplifying, the skill needed for assembly and achieving the purposes of fast assembly and lowering the cost of production.

What is claimed is:

1. A lockable hinge joint, comprising:

two inner shell halves forming a disk portion at one end thereof and a base portion at the other end thereof;

two outer shell halves forming a circular lid portion at one end thereof covering the outer surfaces of said disk portion of said two inner shell halves and a base portion at the other end thereof, said two outer shell halves having a central pivot bolt rotatably connecting said circular lid portion thereof to said disk portion of said two inner shell halves, and one said outer shell half defining an annular space together with one said inner shell half at said circular lid portion;

a ring plate rotatably disposed in said annular space and coaxial with said circular lid portion and said disk portion, said ring plate having an extension on one side thereof, said extension having a stop formed thereon outside of said disk portion bent relative to the plane of said ring plate, and said ring plate further having a tension spring connecting said ring plate to an adjacent said outer shell half;

a plurality of spaced notches defined in the curved peripheral edge of said disk portion of said two inner shell halves;

a locking pawl disposed between said two outer shell halves for radial movement relative to said disk portion into and out of said notches of said disk portion; and a pull handle pivotably connected between said two outer shell halves having a portion thereof engageable with said locking pawl for moving said locking pawl out of said notches;

wherein said stop of said ring plate is movable under the tension force of said spring to a position between said locking pawl and a said notch to prevent said locking pawl from entering said notch.

2. The lockable hinge joint of claim 1, wherein said disk portion has a recess along said peripheral edge thereof and said stop has a raised portion thereon for engagement with said recess to move said stop from in front of a said notch upon relative rotation of said disk portion and said circular lid.

3. The lockable hinge joint of claim 1, wherein said two outer shell halves have a sidewall edge and said two inner shell halves have a sidewall positioned such that when said bases are colinear said sidewall edge abuts against said sidewall.

4. The lockable hinge joint of claim 1, wherein said extension of said ring plate has a space therein adjacent said stop for receiving said locking pawl.

5. The lockable hinge joint of claim 4, wherein said extension has a spring stop affixed thereto on the other side of said space to which said tension spring is connected.

6. The lockable hinge joint of claim 5, wherein said two outer shell halves have a further spring stop to which said tension spring is also connected, said extension further having a stop for engaging said further spring stop.

7. The lockable hinge joint of claim 1, wherein said two outer shell halves have a slot receiving said locking pawl.

8. The lockable hinge joint of claim 7, wherein said locking pawl has a spring biasing said locking pawl toward said disk portion.

* * * * *